US006051800A

United States Patent [19]

Barrett

[11] Patent Number: 6,051,800

[45] Date of Patent: Apr. 18, 2000

[54] SNAP ACTION SWITCH

[75] Inventor: Michael P. Barrett, Elizabethtown, Ky.

[73] Assignee: E.M.B. Corporation, Elizabethtown, Ky.

[21] Appl. No.: 09/137,091

[22] Filed: Aug. 20, 1998

[51] Int. Cl.[7] ..... H01H 5/06

[52] U.S. Cl. ..... 200/454; 200/454

[58] Field of Search ..... 200/453–458

[56] References Cited

U.S. PATENT DOCUMENTS

| | | | |
|---|---|---|---|
| 4,196,325 | 4/1980 | Povilaitis | 200/67 A |
| 4,196,328 | 4/1980 | Ishikawa | 200/246 |
| 4,309,149 | 1/1982 | McCombs, Jr. | 417/63 |
| 4,916,274 | 4/1990 | Hawley et al. | 200/457 |
| 5,471,024 | 11/1995 | Ross et al. | 200/458 |

*Primary Examiner*—Michael L. Gellner
*Assistant Examiner*—Nhung Nguyen
*Attorney, Agent, or Firm*—Maurice L. Miller, Jr.

[57] ABSTRACT

An improved snap action or sump pump switch is disclosed which conventionally includes a housing defining a depression therein and being open on a bottom side thereof; a movable, U-shaped contact support bridge, a coiled actuator spring containing a standard pivot bushing on one end thereof and having an opposite end fitted against the bridge, and an elongated actuator arm or operating lever having a rounded end projecting into the pivot bushing and a pair of laterally projecting, cylindrically shaped ears adapted for disposition in sockets contained in and defined by the housing. Once assembled, these components are held in a stable cooperative relationship relative to one another due to the actuator ears being disposed in forwardly opening, rearwardly projecting slots defined by shoulders projecting from rear inside walls of the housing such that the compressed spring continually urges the ears of the actuator arm rearwardly against the bases of the slots. The switch components are thus easily assembled by hand or otherwise into the required cooperative relationship within the housing and do not require extraordinary means for holding them in the required relationship prior to and during placement of a cover on the housing.

3 Claims, 4 Drawing Sheets

FIG. 1
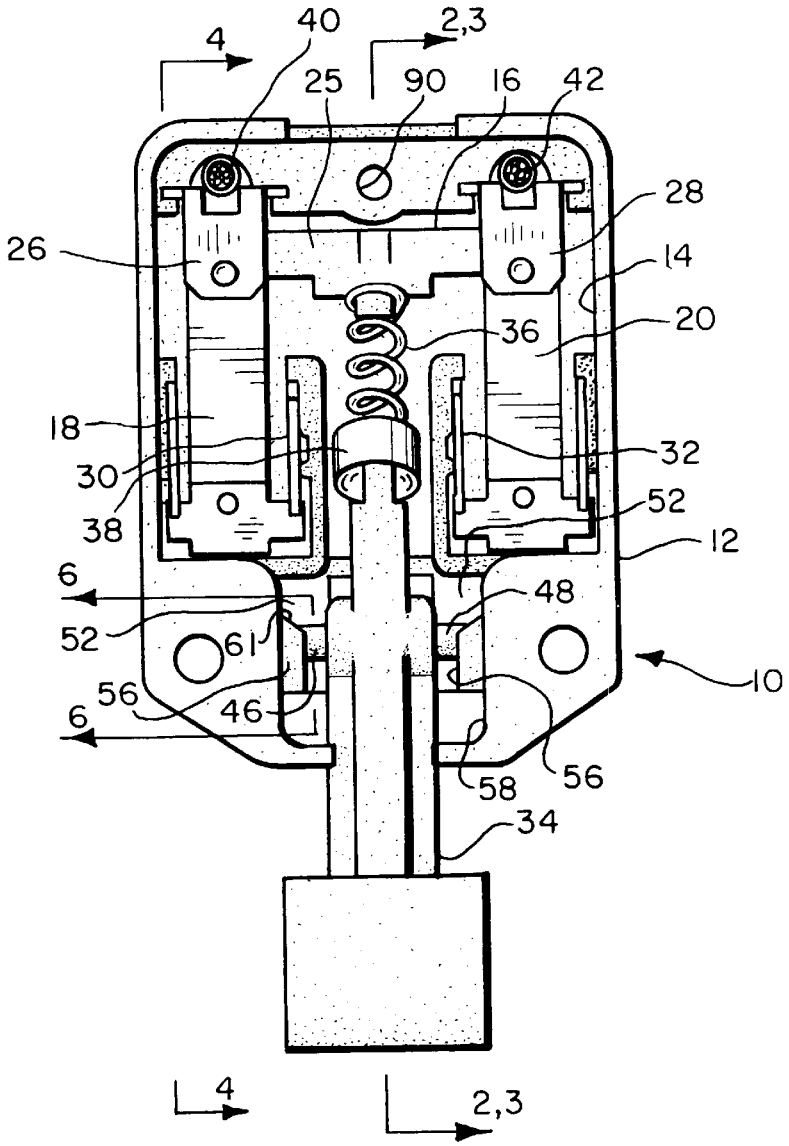
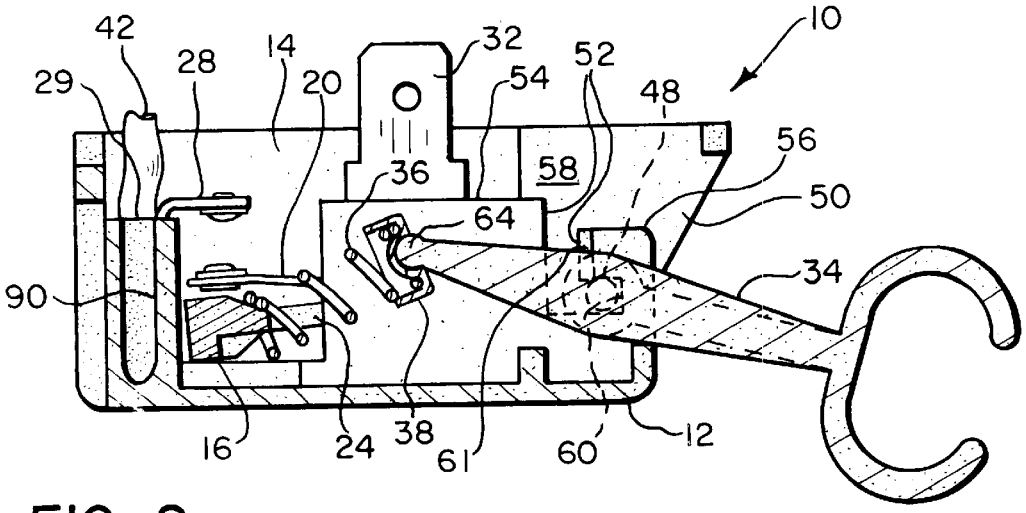
FIG. 2

SNAP ACTION SWITCH

BACKGROUND OF THE INVENTION

This invention relates generally to electrical switches and, more particularly to electrical switches of the snap action type such as are used with a float bulb to operate a sump pump.

Broadly speaking, such switches have long been known and used in the prior art. See, for example, U.S. Pat. No. 4,196,325 issued to S. A. Povilaitis on Apr. 1, 1980 and U. S. Pat. No. 4,916,274 issued to R. H. Hawley et al. On Apr. 10, 1990. A problem encountered with these prior art switches is in assembling their components by hand within the depression formed in the switch housing and in maintaining a cooperative relationship between the assembled components until a cover can be applied to the housing to hold such components in proper operating position relative to one another.

In such a switch, an electrically insulated U-shaped bridge support, which carries a pair of electrically conductive contact bridges on parallel extending, spaced apart arms thereof, is switched between a closed position, wherein the bridges contact fixed wire lead terminals, and an open position, wherein the bridges break contact with the terminals. The switching occurs due to rocking movement of an elongated actuator arm or operating lever which has a pair of transversely projecting, cylindrically shaped ears which are seated in a pair of vertically extending and upwardly opening slots formed in interior walls of the housing. A forward end of the operating lever is rounded so as to fit within a semi-spherical depression in a pivot bushing mounted on one end of a coiled actuator spring. The other end of the actuator spring fits around a tab located in the center of a cross member of the bridge support. The spring is thus held in compression between the rounded end of the operating lever and the cross-member of the bridge support such that, when the operating lever is actuated to rock the rounded end thereof toward the housing cover, the cross-member is moved by the spring in the opposite direction to close the contact bridges against the fixed wire lead terminals. Conversely, when the operating lever is actuated to rock the rounded end toward the upper surface of the housing, the spring forces the cross member to move in the opposite direction toward the cover to disengage the contact bridges from the wire lead terminals.

A difficulty encountered with this type of prior art switch is in assembling the spring, with its pivot bushing on the spring end opposite the rounded end of the operating lever, placing the other end of the spring around the tab on the cross member of the support bridge, and then placing the operating lever in the housing so that its ears are pressed against the bases of the corresponding slots while, at the same time, holding the rounded end of the operating lever against the pivot bushing in the spring. Failure to successfully accomplish this relatively complex maneuver will result in failure to place these parts in the necessary cooperative relationship with one another. Another difficulty encountered with such a switch is in holding these parts in the proper cooperative relationship until the cover is properly placed on the housing to maintain the required relationship By means of my invention, these and the other difficulties encountered using prior art snap action switches are substantially overcome.

SUMMARY OF THE INVENTION

It is an object of my invention to provide an improved snap action or sump pump switch.

It is a further object of my invention to provide such a switch wherein the components of the switch actuating mechanism are readily assembled by hand within a switch housing into a stable operative assembly.

It is another object of my invention to provide such a switch wherein, once assembled within a housing, the switch actuating components maintain a stable relationship with one another without needing to be physically held in such a relationship while the cover is being applied to the housing.

Briefly, in accordance with the objects of my invention, I provide an improved snap action switch of the type which conventionally includes a housing containing a chamber therein and an access opening on a bottom end thereof. The switch also includes the usual U-shaped contact support bridge, a conventional coiled bridge support actuator spring, a pivot bushing mounted on one end of the spring, and an elongated actuator arm having a pair of cylindrically shaped ears projecting laterally from a central portion of the arm and having a forward end pressing against the pivot bushing to hold the spring in compression against the bridge. The improvement of my invention comprises a pair of laterally spaced apart shoulders formed on and projecting medially from opposing rear side walls of the housing. The shoulders each define a forwardly opening, rearwardly extending slot. Each of the slots is adapted to receive one of the actuator ears therein such that the spring continually urges the ears rearwardly in the slots against the bases thereof.

These and other objects, features and advantages of the subject invention will become apparent to those skilled in the art from the following detailed description and attached drawings upon which, by way of example, only a preferred embodiment of my invention is explained and illustrated.

BRIEF DESCRIPTION OF THE DRAWINGS

FIG. 1 shows a bottom plan view of a switch, thus illustrating a preferred embodiment of my invention.

FIG. 2 shows a cross-sectional side elevation view of the switch of FIG. 1 as viewed along cross-section lines 2—2 of the latter mentioned figure, the switch of this figure being shown in an open position.

DESCRIPTION OF THE PREFERRED EMBODIMENT

Figure 3:
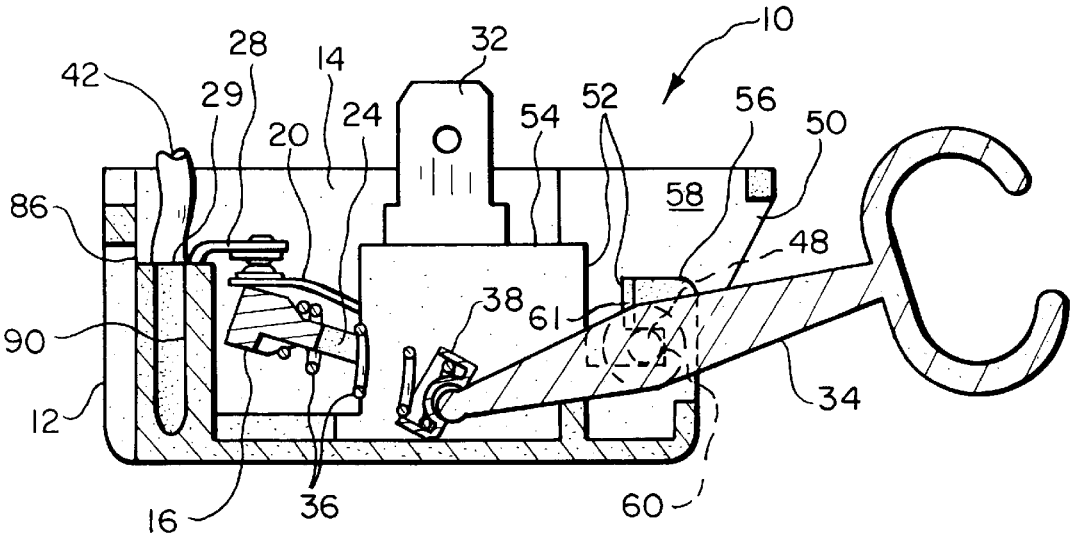
FIG. 3 shows a cross-sectional side elevation view of the switch of FIGS. 1–2 as viewed along cross-section lines 3—3 of FIG. 1, the switch of this figure being shown in a closed position.
Figure 4:
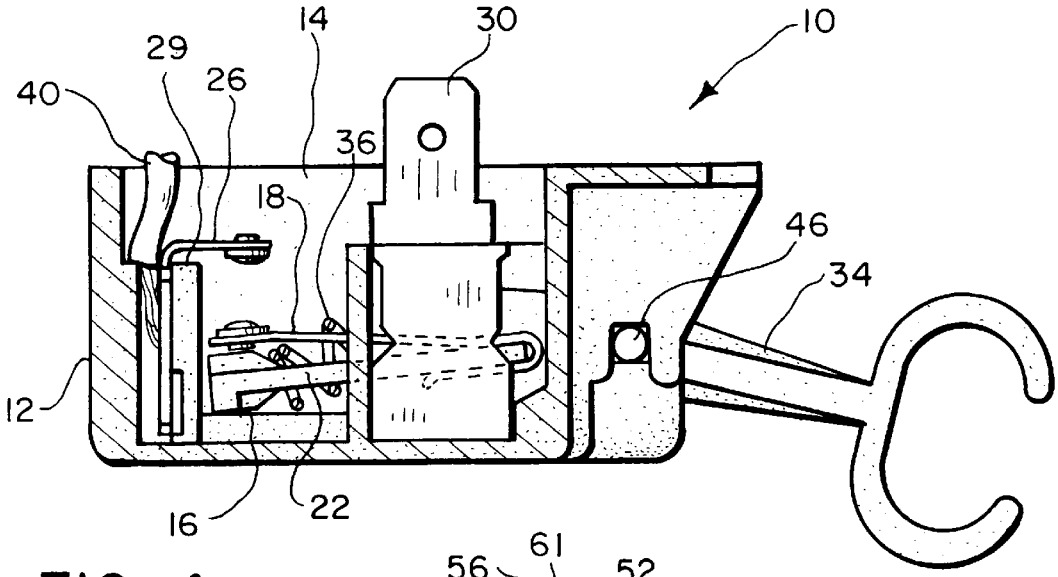
FIG. 4 shows a cross-sectional side elevation view of the switch of FIGS. 1–3 as viewed along cross-section lines 4—4 of FIG. 1, the switch of this figure being shown in an open position.
Figure 6:
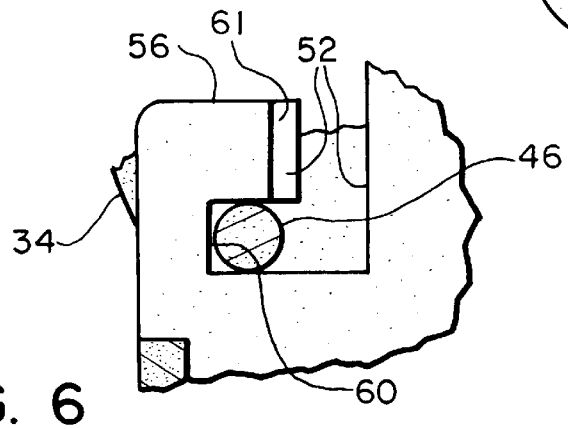
FIG. 6 shows a cross-sectional side elevation view of a fragment of the switch of FIGS. 1–5 as viewed along cross-section lines 6—6 of FIG. 1.
Figure 5:
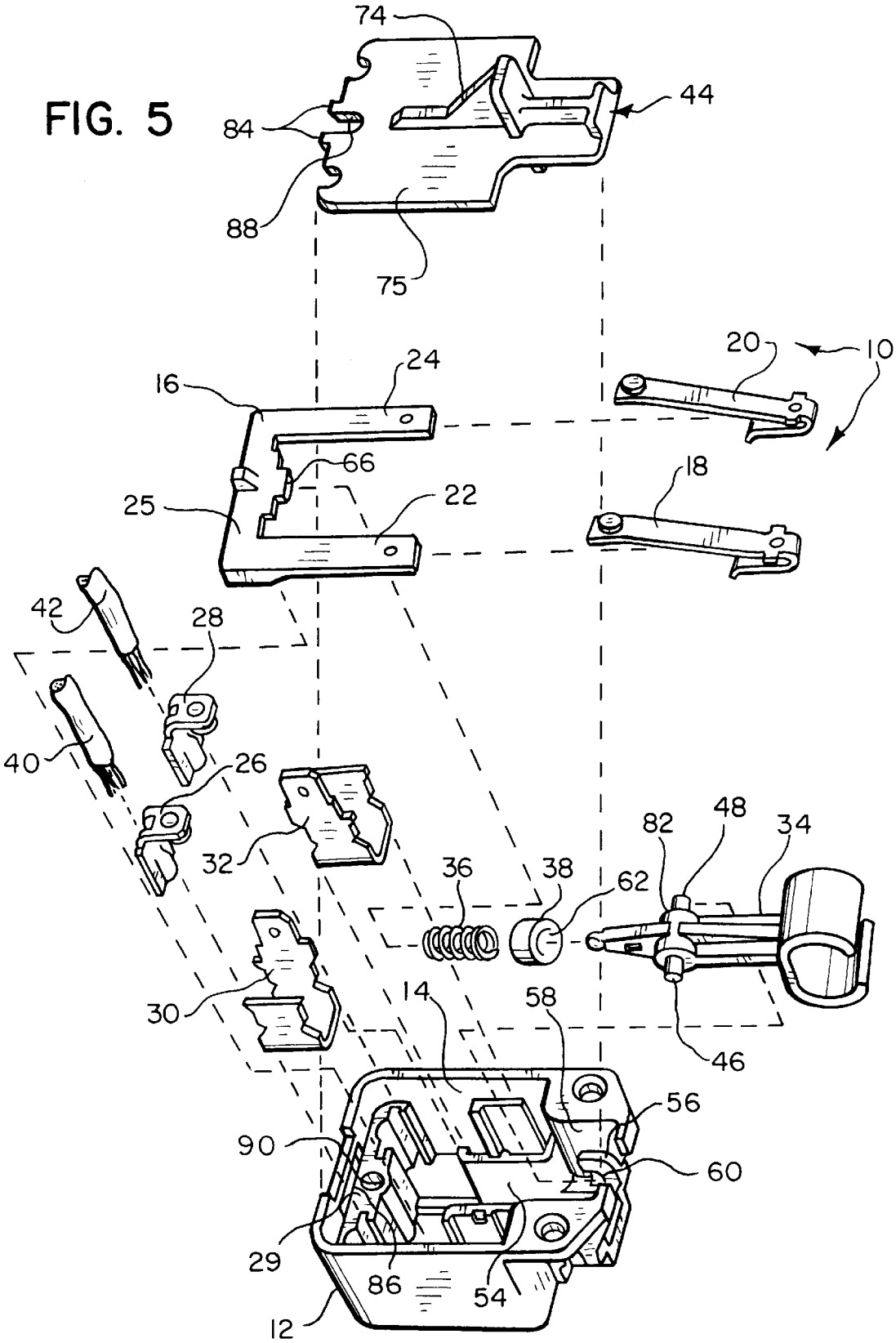
FIG. 5 shows an exploded perspective view of the switch of FIGS. 1–4, together with a cover.

Referring now to the drawing figures, in particular, to FIGS. 1–6, there is shown, in a preferred embodiment of my invention, an improved snap action switch, generally designated 10, which can be used, for example, with a float bulb to activate a conventional basement sump pump and for other purposes. The switch 10 includes a housing 12 which is preferably a molded, electrically insulative plastic defining an interior space or depression 14 in which various switch components can be disposed. Such components include a U-shaped, electrically insulative contact bridge support 16, a pair of electrically conductive contact bridges 18 and 20 mounted on parallel extending, spaced apart arms 22 and 24, respectively, of the support 16, the arms being joined at their forward ends by a cross-member 25. Such components further include a pair of fixed, electrical lead terminals 26 and 28 mounted in spaced apart relationship on a front deck 29 of the housing 12 in line with the contact bridges 18 and 20, and a pair of externally accessible contact bridge terminals 30 and 32. Also included in the switch 10 is an actuator arm or operating lever 34, a coiled bridge support actuator spring 36, a pivot bushing 38, and a pair of insulated, flexible electrical leads 40 and 42. Lastly, a conventional cover 44 (See FIG. 5) is included which can be snap fit onto the housing 12 to cover the otherwise open bottom end thereof as later more fully explained in relation to FIGS. 5 and 7–9.

Broadly speaking, the previously mentioned components, with the exception of a part of the housing 12, to be hereinafter identified and described, and the manner in which the actuator arm 34 is held in the housing, is conventional. Now, for purposes of mounting the actuator arm 34 in the housing 12, it will be noted that the actuator arm 34 contains a pair of the usual cylindrically shaped ears 46 and 48 which project laterally from opposite sides of a longitudinally central collar 82 thereof. The actuator arm 34 tilts or rocks about the ears 46 and 48 to tilt the spring 36 to, in turn, move the bridge 16 so as to open or close the switch 10 when properly mounted in the housing 12. A central portion of a rear wall of the housing 12 defines an open region or actuator chamber 50 into which a forward portion of the actuator arm 34 can be lowered to place the forward end portion into the interior space 14 of the housing. A rearward portion of the arm 34 projects out of an open area in a rear wall of the housing 12 for connection to a float bulb rod, not shown, in the usual, well known manner.

More specifically, as best shown in FIGS. 1-2, the laterally projecting actuator ears 46 and 48 can be lowered into a space 52 located between rear sides of a pair of mounting decks 54 for the contact bridge terminals 30 and 32 and tapered front edges of a pair of shoulders 56 which project medially from a pair of opposing rear inside walls 58 of the housing 12, which walls partially define the actuator chamber 50. The shoulders 56 each define a forwardly opening and rearwardly extending slot 60 which opens into the space 52 (See also FIGS. 3 and 6). The shoulders 56 may contain tapered front edges or tapered forwardly facing walls as shown at 61 in FIGS. 1–3. Once the ears 46 and 48 are lowered into the space 52 to the level of the openings to the slots 60, the ears are then inserted rearwardly into the slots and against the bases thereof. The pivot bushing 38 is then placed on a rear end of the actuator spring 36 so that a rounded or semi-spherical depression 62 therein engages a rounded forward end 64 of the actuator arm 34 (See FIG. 5). A forward end of the spring 36 is then placed around a rearwardly projecting tab 66 located on the center of a cross-member of the bridge support 16. See also FIG. 5. Thus, the spring 36 is held in compression between the cross-member of the support 16 and the end 64 of the actuator arm 34 so that the ears 46 and 48 are continually forced rearwardly against the base of the slots 60, regardless of the position of the actuator arm 34 or the movement thereof, so long as the electrical lead terminals 26 and 28 remain fully seated in the front deck 29.

This feature of the forwardly opening, rearwardly projecting slots 60 and the cooperation of the spring 36 in compression between the bridge support 16 and pivot bushing 38 urged against the actuator arm 34 for all positions and movements of the actuator arm is important in maintaining the ears 48 solidly in the slots 60. Because of this feature, the cover 44 is not required to be in place on the housing 12 in order to maintain the actuator arm 34 in a stable operative position in the housing nor in stable operative cooperation with the spring 36 and movable bridge support 16. In other words, once the switch components are properly assembled no extraordinary means is required to hold the components in the required position relative to one another before and during application of a cover to the housing as has been required when assembling prior art sump pump switches.

Figure 7:
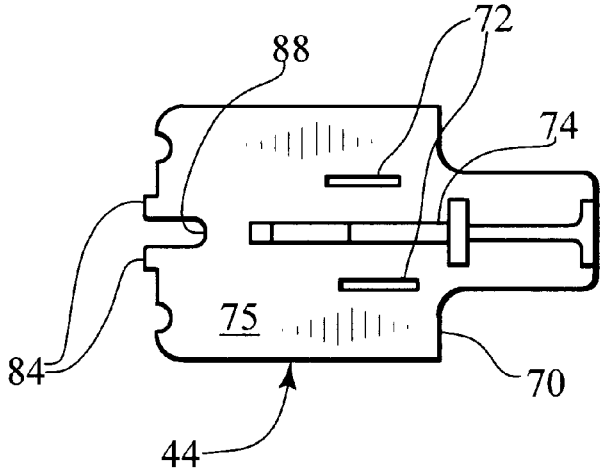
FIGS. 7–9 show an outside plan view, a side elevation view, and an inside plan view, respectively, of the cover of FIG. 5 as it relates to a housing of the switch of the previously mentioned figures to which it can be fastened.
Figure 8:
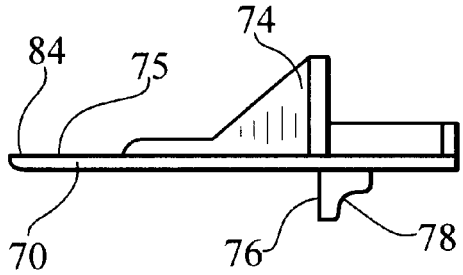
Figure 9:
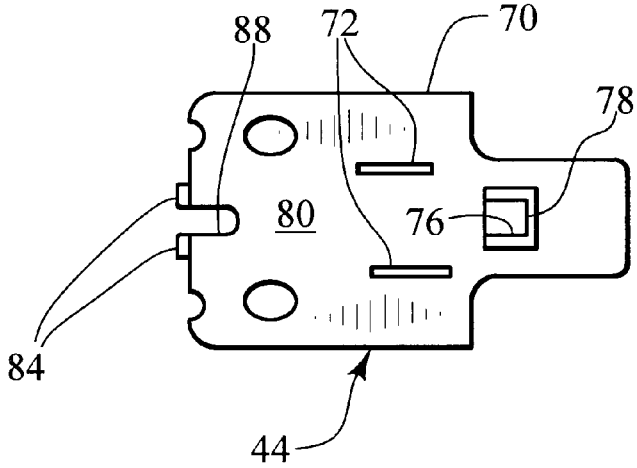

The conventional cover 44 is shown in detail in FIGS. 7–9 and includes a flat plate 70 with a pair of slots 72 therethrough, through which the contact bridge terminals 30 and 32 project for external access thereto when the switch 10 is fully assembled with the cover in place. An optional raised reinforcing rib 74 extends along a major portion of the longitudinal centerline of the cover 44 on an outer facing surface 75 of the plate 70. A shoulder 76, having a rounded corner 78, as best shown in FIG. 8, extends from an inside facing surface 80 of the plate 70 to slidably bear against the collar 82 (See FIG. 5) of the actuator arm 34 from which the ears 46 and 48 project when the switch 10 is fully assembled with the cover 44 in place of the housing 12. A pair of spaced apart, forwardly projecting tabs 84 of the cover 44 fit within an elongated slot 86 (See FIGS. 3 and 5) in a front wall of the housing 12. A self-tapping screw, not shown, can be used if desired, to secure the cover 44 to the housing 12 by first placing the cover on the housing with the tabs 84 in the slot 86 and, thereafter, inserting the screw through a cover slot 88 between the tabs 84 and threading it into a blind hole 90 formed in the center of the deck 29. Such fastening of the cover 44 to the housing 12 is optional as the cover is designed to snap fit securely in position without the use of a threaded fastener. The cover 44 is preferably constructed of a molded plastic and should be an electrically insulative material.

Although the present invention has been described and shown with respect to specific details of a preferred embodiment thereof, it is not intended that such details limit the scope and coverage of this patent other than as specifically set forth in the following claims.

I claim:

1. An improved snap action switch of the type which conventionally includes a housing having an interior surface which defines a depression therein; a U-shaped contact bridge support; a pair of electrically conductive contact bridges mounted on parallel extending, spaced apart arms of said bridge support; a pair of fixed electrical lead terminals mounted in said housing in line with said contact bridges; a pair of externally accessible contact bridge terminals; a coiled bridge support actuator spring; a pivot bushing mounted on one end of said spring, the other end of said spring being mounted against said support; and an elongated actuator arm having a pair of cylindrically shaped ears projecting laterally from a central portion of said arm and having a forward end pressing against said pivot bushing to hold said spring in compression against said contact bridge, the improvement of which comprises a pair of laterally spaced apart shoulders formed on and projecting medially from opposing rear side walls of said housing, said shoulders defining a pair of forwardly opening, rearwardly extending slots therein, each of said slots being adapted to receive one of said ears therein such that said spring urges said ears rearwardly in said slots against bases thereof.

2. The switch of claim 1 wherein said shoulders include tapered front edges.

3. An improved snap action switch of the type which conventionally includes a housing having an interior surface defining a chamber therein and an access opening on a bottom end thereof; a U-shaped contact support bridge having a pair of parallel extending, spaced apart arms and a cross-member extending between corresponding ends of said arms, said cross-member including a tab extending from a central portion of said cross-member in the same direction as said arms extend from said cross-member and being in the same plane as said arms; a coiled bridge support actuator spring; a pivot bushing containing a semi-spherical depression in one end thereof mounted on one end of said spring, the other end of said spring being mounted against said cross-member and surrounding said tab; an elongated bridge support actuator arm having a pair of cylindrically shaped ears projecting laterally from a central portion of said arm and a rounded end projecting into said pivot bushing depression to hold said spring in compression against said crossmember, the improvement of which comprises a pair of laterally spaced apart shoulders formed on and projecting medially from opposing rear side walls of said housing, said shoulders defining a pair of rearwardly extending, forwardly opening slots, each of said slots being adapted to receive one of said ears therein such that said spring continually urges said ears rearwardly in said slots against bases thereof.

* * * * *